United States Patent [19]

Maria De Bree et al.

[11] Patent Number: 4,891,888

[45] Date of Patent: Jan. 9, 1990

[54] AUXILIARY TOOL FOR CAREFULLY LEVELLING FINISHING FLOORS

[75] Inventors: Cornelius H. Maria De Bree, NK Driebergen; Marinus Reincke, MD Langbroek, both of Netherlands

[73] Assignee: 501 Redexim B.V., Netherlands

[21] Appl. No.: 192,490

[22] Filed: May 11, 1988

[30] Foreign Application Priority Data

May 12, 1987 [NL] Netherlands ..... 8701124

[51] Int. Cl.[4] ..... G01C 15/02

[52] U.S. Cl. ..... 33/293; 33/DIG. 21; 33/518

[58] Field of Search ..... 33/169 B, 293, 1 H, 33/613, 518, DIG. 21, 295, 299, 227, 228, 286; 83/13, 522

[56] References Cited

U.S. PATENT DOCUMENTS 1,523,437 1/1925 McMillan ..... 33/169 B X 3,811,348 5/1974 Brown ..... 33/293 X

*Primary Examiner*—Harry N. Haroian

*Attorney, Agent, or Firm*—Bauer & Schaffer

[57] ABSTRACT

Starting from a mark (G) provided on a wall of the room, plugs are cut from a plastic rod (11), which is adjustable within a tube (1) of the tool, which is supported through legs (3; 23) by the underground . The cutting takes place at the location of a quantity of adhesive provided on the ground, so that the plug adheres to the ground. The upper surfaces of the plugs then indicate the correct height of the floor of flowing mortar to be provided. The correct plug height is obtained at each location when a laser receiver (9; 35) connected to the tube is coincident with a stationary positioned laser beam (20).

7 Claims, 4 Drawing Sheets

36
35
27
28
34
1
F
25
26
30
37
24
40
H
W
G
1000

AUXILIARY TOOL FOR CAREFULLY LEVELLING FINISHING FLOORS

BACKGROUND OF THE INVENTION

The invention relates to an auxiliary tool for levelling a finishing floor made of flowable mortar or similar material, whereby at each desired location of a floor or a building an exact floor height or level for the finishing layer to be provided is plotted by means of a separate mortar plug, said tool comprising a laser receiver.

In addition to the finishing floor being horizontally level or extending with a perdetermined slant, the finishing floor should be smooth when receiving a floor-covering or when being the "surface layer".

Up until now, a board or stick has been used as an auxiliary tool. The board has at its upper end a laser receiver, or simply receives a laser beam or visibly thereon when the laser beam passes thereon. The board has at its lower end a horizontal transverse member, for example, a tile. In use, the bottom surface of the tile is placed in the same plane as a level mark provided on a wall of the building in which the finishing floor has to be provided (the mark being, for example, a couple of centimeters below the lower threshold of a door opening). To place the tile in the proper plane, the tile is made to rest on a mortar plug, built up to the proper height. Thereafter, the laser receiver is adjusted at each desired floor location to the height of the laser beam, and an amount of mortar is placed on the floor, the tile being pressed on top of the mortar until the laser beam coincides with the receiver, whereby the upper surface of the mortar comprises the exact floor height or level. After the partial hardening of the floor the mortar plugs are removed, and the holes formed thereby are filled with the same material as the finishing floor.

It is also possible when using flowable mortar to hold the board at the coinciding height of the laser beam until the layer, flowed onto the underfloor, reaches the lower surface of the board or tile (see U.S. Pat. No. 4,114,220). However, this second method is very inaccurate.

The use of the board as an auxiliary tool has a disadvantage of requiring a laborious process as follows:

first the location in which a mortar plug is to be provided is moistened by a brush and water;

secondly, the location is made adhesive by mortar slurry (mortar having a large cement concentration); and thirdly, the mortar is placed by means of a trowel;. and thereafter the tile is placed onto the mortar and the height adjusted.

Due to the laboriousness of the process one often determines the floor height with few mortar plugs distances from each other, which is not very accurate. Also, moistening and making the floor adhesive is often eliminated. Thus, if the floor is not very rough, the mortar does not adhere thereto and remains loosely positioned, so that when thereafter the finishing floor is poured, the mortar plugs may shift, and again, inaccuracies occur.

From DE-A-No. 2827521 a tool is known for levelling floors, comprising an outer tube erected vertically to the floor by means of three supporting legs connected thereto. A second tube, vertically slideable within the outer tube carries graduated indicia. A horizontal plate is attached at the lower end of the entire tube. The desired level of the plate above the underfloor is adjusted through a sighting instrument or a laser beam. The flowable mortar has to be swept over the floor until it reaches the lower plate surface. It is a disadvantage of this method that it is not very accurate.

Furthermore, a frame is known from EP-A-No. 0077070 which is provided with a laser detector. A vertical tube is carried by the frame, which may be lowered onto an amount of adhesive present on the underfloor. As determined by coincidence of the laser beam, a lower portion of the tube is cut therefrom through the use of a circular saw provided on the frame. These plugs that are so cut and left on the floor have the desired height for the finishing floor. The apparatus has the disadvantage that it is large, and it requires an electric current supply for the circular saw.

The invention aims at removing the foregoing disadvantages.

SUMMARY OF THE INVENTION

A feature of the invention is an auxiliary tool comprising an outer tube which is adapted to be placed vertically to the underfloor through the use of at least three supporting legs connected therewith and a rod or tube of plastic material in the outer tube and slidable relative to the tube so that a plug of the material can be cut from the plastic tube. A measuring pin projects transversely from the outer tube, and a laster receiver is connected to the tube.

An amount of adhesive is first provided at predetermined location on the floor so that after cutting the plastic tube, the cut portion adheres to the floor.

An advantage of the invention lies in the fact that quick plotting of plugs which determine the floor height may be done by one man and means a cost savings of 200 to 300% relative to the known method. There are no longer loose plugs, and because the plugs can easily be placed, they may be provided at smaller spacings. For example, 60 to 80 plugs per hour may be placed so that per hour a space having an area an area as great as 400 to 500 meters square may be prepared for the pouring of the finishing floor.

In a preferred embodiment of the invention a pumping mechanism is secured to the outer tube. The mechanism has a piston within the tube, adapted to move the plastic tube downwardly while simultaneously moving the outer tube upwardly until the laser beam coincides with the laser receiver. When the plastic tube is cut flush with the lower end of the outer tube, the result is a plug having the desired height. In this embodiment it is not necessary to hold the outer tube by one hand at the height of coincidence of the laser beam, while attending to the cutting with the other hand.

It is another feature of this invention to provide a knife secured to the lower end of a rod, connected to the outer tube parallel therewith and pivotal around its longitudinal axis. The rod is biased by a spring towards a position where the knife is non-operative. The knife is actuated by means of a transverse handle provided at the upper end of the tube. Thereby it is not necessary for the user to take a position with bent back close to the ground in order to cut the plastic tube.

It is another feature of the invention that the measuring pin be provided adjacent to the upper end of the outer tube, since usually the so called meter level is marked on the wall of the building, for example, as a mark, which is one meter above the desired floor height. In this case the measuring pin may be adjusted more accurately, because it is at eye level to the operator when he slightly bends his back. Thus, it is easier to guage the tool—that is, to initially adjust the lower end of the outer tube to the desired height of the finishing floor.

In another embodiment of the auxiliary tool according to the invention, the outer tube is displaceable against the bias of compression springs provided around the supporting legs such that the laser receiver coincides with the laser beam. In this embodiment the tube has to be supported by hand against the spring bias during the cutting of the mortar plug.

In order to permit easy transportation of the tool with the plastic tube from one location to another on the floor, the rod or tube of plastic is preferably connectable at its upper end to a lip provided with a screw threaded aperture. A screw extending through a vertical guid slot in the outer tube of the tool is in engagement with the lip, the screw being released to lower the plastic tube on the floor.

It is preferable that a length scale be provided on the outer tube so that the average height of the plugs provided on the floor may be determined, and thus the average thickness of the finishing floor provided. This permits a determination beforehand of the necessary amount of mortar.

In another embodiment a horizontal guide for a knife or similar cutting member is fixed to the tube just below the tube end. The cutting member is insertable between the lower end and a guide, the guide being provided with a through-going aperture for the plastic tube. This furthers the quick provision of the plugs on the floor.

It is to be preferred to provide the laser receiver to be vertically adjustable on the outer tube of the tool. The laser beam emitter which rotates horizontally is adjusted at such height that the emitted beam is free from obstacles present on the floor so as to reach the laser receiver of the auxiliary tool according to the invention in all floor level adjusting locations. Thus, it will be advantageous if also the laser receiver is vertically adjustable on the auxiliary tool. The laser beam emitter may also be positioned in an adjustably slanting plane relative to the horizontal plane of the floor. Thereby slanting finishing floors may be plotted.

The invention is hereafter explained with reference to the drawing, showing embodiments for the auxiliary tool according to the invention, given as an example.

DESCRIPTION OF THE INVENTION

Figure 2:
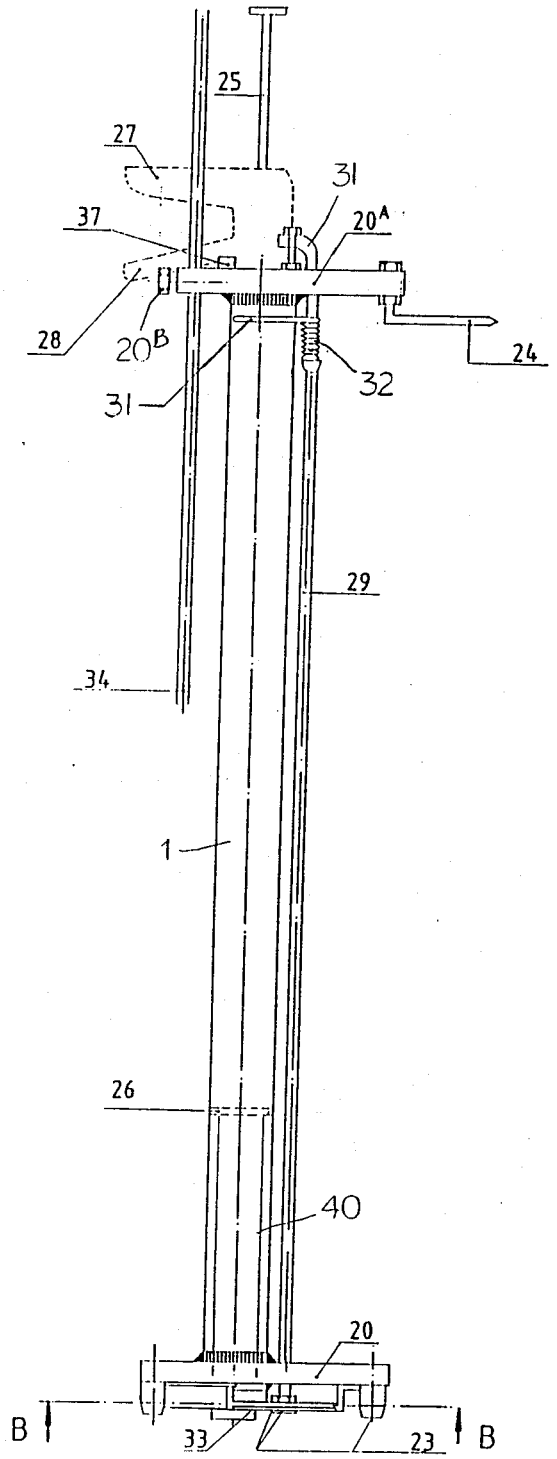
FIG. 2 is an enlarged side view of the tool shown in FIG. 1*a*.
Figure 3:
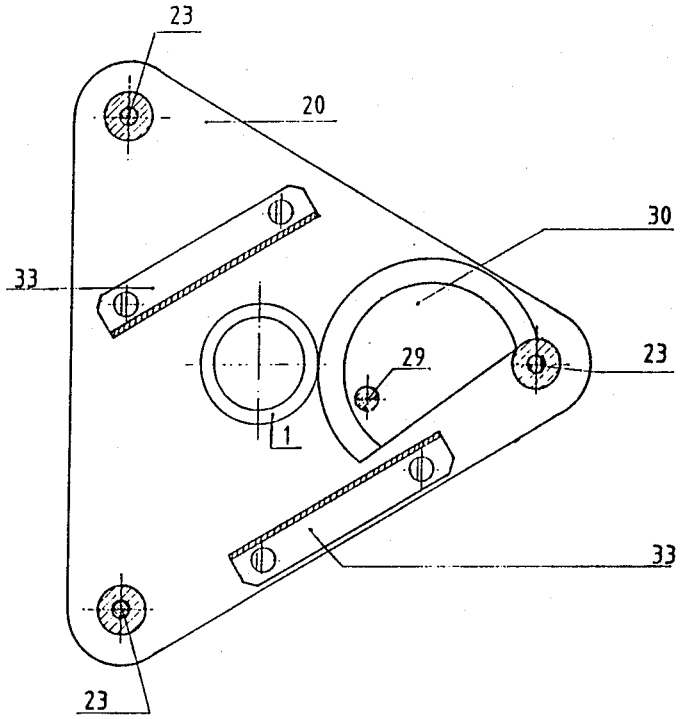
FIG. 3 is a bottom plan view of the tool shown in FIG. 1.

The first embodiment of the present invention is shown in detail in FIGS. 2 and 3. A tube 1 having at its lower end a foot plate 20 is provided with three supporting legs 23. A similar plate 20A is secured to an upper end of tube 1, and a retractable or rotatable measuring pin 24 projects from one side. The spacing between the lower end of tube 1 or the lower end of foot plate 20 and measuring pin 24 is accurately fixed at 1 meter.

A pumping mechanism is provided on top of the upper plate 20A. The pumping mechanism comprises a piston rod 25, having, at its lower end within tube 1, a piston 26. The rod 25 is actuatable through a pair of handles 27, 28, one handle 27 being stationary, and the other handle 28 being moveable. When the movable handle 28 is gripped and moved towards stationary handle 27, piston rod 25 may be moved downwardly, employing an interal mechanism such as a pawl and ratchet as is well known in the art of adhesive spray guns.

As best shown in FIG. 2, a rotatable vertical rod 29 is provided, extending between plates 20 and 20A. The vertical rod 29 has at its lower end, just below foot plate 20, a knife or cutting member 30 (FIG. 3). The rod 29 is rotatable around its axis through a handle 31, provided at its upper end. Also a torsion spring 32 is provided around rod 29, which, after the handle 31 is released, returns the rod 29 to its starting position. This starting position is also shown in FIG. 3. A guiding plate 33 is provided below knife 30 on the foot plate 20, ends of the guiding plate 33 being connected to plate 20 as shown in FIG. 3, whereas the plate itself is omitted therefrom in order to allow viewing the lower side of the plate 20. A vertical rod 34 is slidably mounted in the upper plate 20A and is adapted to be adjustably fixed by a screw 20B. The rod 34 is adapted to carry a laser receiver 35 at its upper end as seen in FIG. 1.

The operation of the auxiliary tool shown in FIGS. 2 and 3 is illustrated in FIG. 1. The tool placed on the underfloor F adjacent a wall W to be worked on, and the lower handle 28 of the pumping mechanism downwardly from the position indicated in FIG. 1 so that the piston rod 25 is moved fully upwardly whereby piston 26 becomes situated in the top of outer tube 1. Thereafter a rod or tube of plastic material 40 (see also FIG. 3) is inserted into tube 1 from below until its upper end engages piston 26.

Figures 1A, 1B:
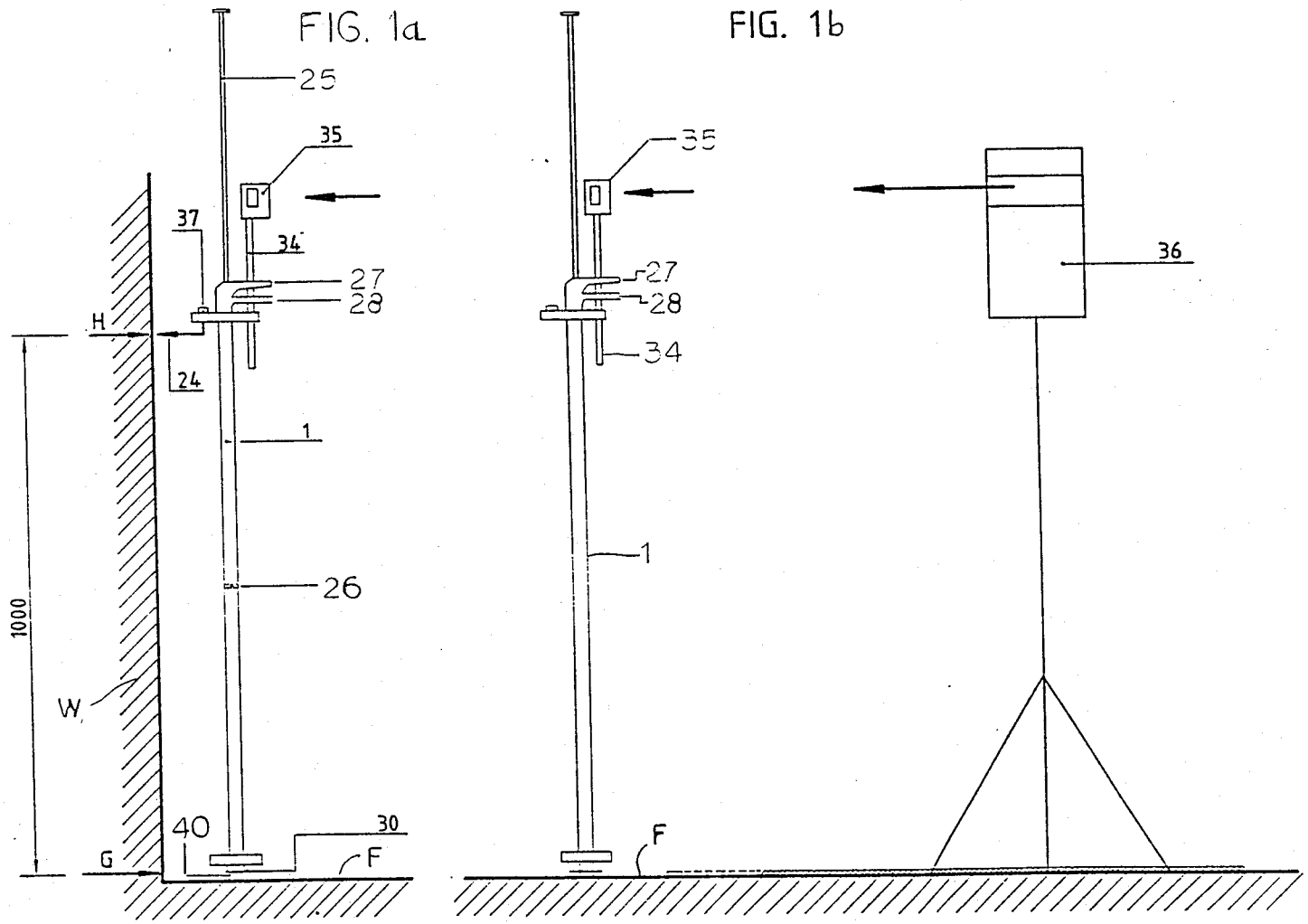
FIG. 1*a* is a side view of a first embodiment of the tool.
FIG. 1*b* is a view similar to that of FIG. 1*a*, showing the auxiliary tool in use with a laser projector.

Before the auxiliary tool can level the finishing floor the tool is first gauged as seen in FIG. 1A. The height to which the finishing floor is to be provided on the underfloor F is indicated by mark G which, for example, is derived from the threshold height of door openings in the room walls. Starting from the mark G, a distance of 1 meter is scribed on the wall W by the pin 24 forming the height mark H (the so-called meter level) using the meter length of the tube 1, or otherwise this meter level is the gauging mark for the tool. After placing the tool on the floor, the plastic rod 40 is now moved downwardly by operating the pumping mechanism handles 27, 28. When rod 40 reaches floor F, tube 1 will move upwardly should the pumping be continued, and the measuring pin 24 is conjointly extended, and the pumping is continued until the measuring pin 24 is at the level of mark H. The spacing between measuring pin 24 and knife 30 is then also 1 meter (1,000 mm), and the extending portion of the rod 40 below the plate 20 defines the depth of the finished floor. If now plastic rod 40 would be cut by knife 30, the upper end of the plug cut therefrom is at the floor level mark G.

Thereafter, the laser receiver 35 is adjusted, through adjustment of the rod 34 and screw 20B (see FIG. 2), to the height in which it coincides with the beam emitted by a laser emitter 36 which has been fixedly and stationary provided elsewhere in the room. During this procedure it is important that outer tube 1 also extend substantially vertically. To this end, a planar levelling instrument 37 is provided on upper plate 20A.

At spacings which are determined by the operator and varying from 1 to 5 meters, small amounts of an adhesive are provided as with a spray gun. Thereafter tube 1 is placed over one of the adhesive portions. The plastic rod 40 is now moved downwardly by actuation of the pumping mechanism handles 27, 28, until its lower end adheres to the adhesive material. When the pumping is continued, tube 1 itself moves upwardly and continues until the laser receiver 35 coincides with the laser beam from laser emitter 36. Thereafter handle 31 is actuated whereby knife 30 cuts the tubular rod 40.

In this manner plastic plugs may be provided all over the room with each of the upper ends of the plugs being at the height G above floor F. If thereafter the flowable mortar is provided up to the height of the plugs, a finishing floor is obtained, which accurately satisfies the required standards. Not only accurately level finishing floors are provided, but also slanting finishing floors may be obtained. This may be realized by adjusting the laser beam from the laser emitter 36 to be at an angle with the horizontal.

Figure 4:
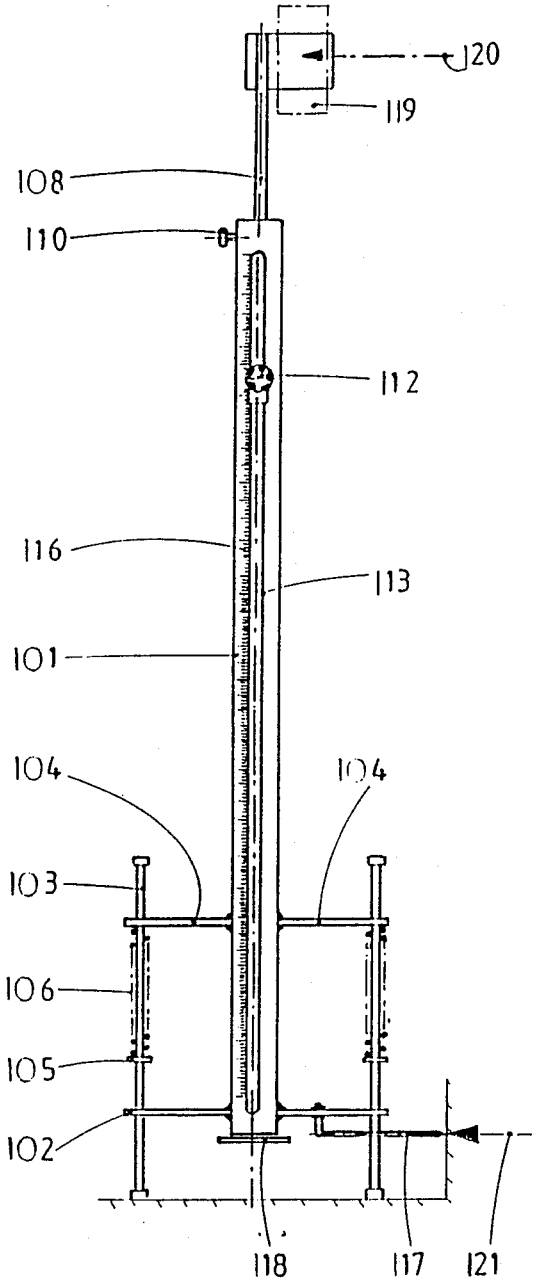
FIG. 4 is an elevational view of a second embodiment of the present invention.
Figure 5:
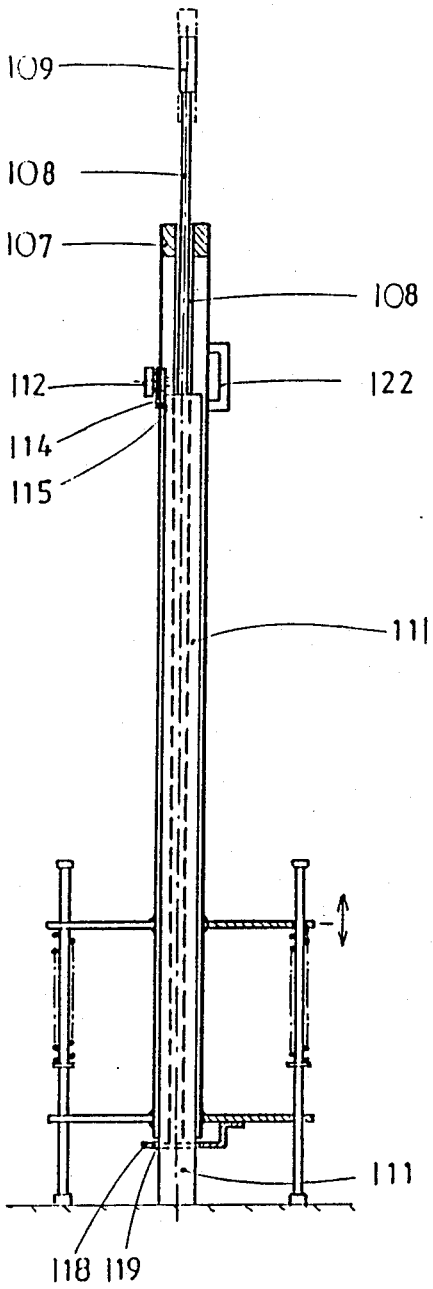
FIG. 5 is another view of the embodiment shown in FIG. 4.

As shown in FIGS. 4 and 5, the second embodiment likewise comprises an outer tube 103 to which three star-like extending horizontal connection rods 102 are secured adjacent the lower end thereof. Through each connecting rod 102 there is provided a vertical leg 3 which is freely moveable therein. A second set of star-like extending horizontal rods 104 are secured to the tube 101 above rods 102, and the legs 103 extend through apertures (not shown) in rods 104. The tubes 103 have a flange 105 mounted between rods 102 and 104, about which a compression spring 106 is provided around each leg 103 between rod 104 and flange 105.

As best shown in FIG. 5, a sleeve 7 is secured at the upper end of tube 101, through which a rod 108 extends and at the upper end of which a laser receiver 109 is secured. The rod 108 is vertically slidable in sleeve 7 and may be secured therein by a clamping screw 110 (see FIG. 4).

Rod 108 constitutes an inner guide for a tube 111, preferably made of a soft plastic material which is easily cutable by a knife, which is insertable through the lower end of tube 101. In the embodiment shown in FIG. 5, tube 111 is securable in tube 101 by a screw 112 which extends through a longitudinal guiding slot 113 in the wall of tube 101. Screw 112 also extends through a screw threaded aperture in a lip 114 within tube 101, the lower end of which has a radially inward projecting point 115. After plastic tube 111 has been inserted into the tube 101 and after the screw has been slid in slot 113 until point 115 is adjacent to the upper end of plastic tube 111, screw 112 is tightened to the right so that point 115 penetrates into the plastic tube and retains it fixed. A length scale 116 is provided along the guiding slot 113 on the exterior of tube 101 so that the length of the plastic plug provided may be derived therefrom.

A measuring pin 117 projecting beyond the corresponding leg 103 is secured to one of rods 102, and a knife guide 118 is secured to another of rods 102 and provided with an aperture 119 through which plastic tube 111 may pass.

The auxiliary tool as described by the second embodiment is operated as follows. In the laser beam emitter device, only the laser beam 120 is switched on. During warming up of the laser device, an amount of adhesive is placed at the intended measuring locations on the floor on which the finishing layer has to be provided. A level mark 121 is provided on the wall of the room in which the floor is to be made. If this mark 121 has not been provided before, the mark may be, for example, a couple of centimeters below the threshold level of a door opening in the room. Now tube 101 is placed in such way, through compression of springs 106, that its lower end is flush with level mark 121 (as seen in FIG. 4) which is facilitated in that measuring pin 117 may be placed at the level of level mark 121. Thereafter the laser receiver 109 is carefully adjusted to the height of laser beam 120 by means of screw 110.

Thereafter tube 101 is pushed downwardly at a measuring location, until laser beam 120 coincides with receiver 109, so that the lower end of tube 101 is at the height, spaced above the floor, that has to be attained when the finishing floor is poured. The screw 112 is released and moved downwardly together with plastic tube 111 held by pin 113 until the lower end of plastic tube 111 reaches the adhesive on the floor. Thereafter, plastic tube 111 is severed with the knife through the slot between the knife guide 118 and the lower end of tube 101. This is done while retaining tube 101 against the bias of springs 106 at the height in which the laser beam 120 coincides with receiver 109. Thereafter the auxiliary tool may be transported towards a next measuring location.

In this manner sixty to eighty plastic plugs may be provided on a floor having an area of 400 to 500 meters squared in about an hour. The length of plastic tube may be cut by aa knife or saw but may also be done by burning through it with a heated wire.

If the length of the plastic plug is read for all plugs on scale 16, it is possible to determine from all heights of the plastic plugs the average height of the finishing layer to be provided. The plastic tube 111 continuously slides downwardly until it is practically consumed, whereafter a new plastic tube may be inserted.

It is not critical to secure plastic tube 111 by screw 112, since plastic tube 111 may also be retained by a thumb through slot 13 when transporting the auxiliary tool by handle 122.

It is only necessary to adjust the laser beam height above the floor once by adjusting the laser emitter or the height of receiver 109 relative to tube 101 in order to permit bringing the height of the plastic plugs everywhere on the floor in the plane through level mark 121.

Finally the auxiliary tool may also be used with a water hose apparatus (not shown) instead of laser beam device. Thereby the correct level of the lower end of tube 101 over the working floor is determined by two communicating vessels, one of which is fixed on tube 101, and one at a fixed distance above level mark 121 on the wall. The vessels mutually communicate through a water filled hose and are both provided with a scale. If the water in the vessel connected to the tube 101 is at the correct scale mark, the lower end of tube 101 is at the intended level above the floor. However, this method is slower than that with a laser device.

Apart from for building floors, the auxiliary tool is also usable for providing finishing layers on solid bases, such as concrete or asphalt roads, athletics courses, and so on. Furthermore, the floors may consist of concrete floors, sand, cement, covering floors, or flowable mortar floors. For easy transport the auxiliary tool may be provided with a handle 122.

We claim:

1. An auxiliary tool for levelling a finishing floor made of flowable mortar or similar material, comprising an outer tube adapted to be arranged vertically with respect to the floor and means for supporting said outer tube with its ower end spaced above said floor, a laser receiver adjustably mounted on said outer tube for receiving a laser beam located at a first predetermined height above said floor, a rod located in said outer tube and slidable axially relative thereto, a measuring pin extending laterally from said outer tube for conjoint movement therewith for alignment with a second predetermined height from said floor, means for relatively moving said outer tube and inner rod so that the lower end of said rod extends from the lower end of said outer tube in contact with said floor and said outer tube is moved to align said laser receiver with said laser beam and said measuring pin with the second predetermined height from said floor, and means for cutting the section of said rod extending below the lower end of said tube whereby said cut rod section determines the desired height of said finishing floor.

2. The auxiliary tool according to claim 1 wherein the means for relatively moving said outer tube and rod comprises a pumping mechanism secured to the outer tube, said mechanism having a piston within the outer tube adapted to move the rod downwardly while simultaneously moving the outer tube upwardly until the said alignment occurs.

3. The auxiliary tool according to claim 1 wherein said supporting means comprises a frame having a plurality of vertical legs, and said cutting means comprises a knife connected to one of said legs, said knife being pivotal around the axis of said leg and being biased by a spring towards a non-operative position, said knife being actuated by means of a transverse handle.

4. The auxiliary tool according to claim 1 wherein the measuring pin is provided adjacent to the upper end of the outer tube.

5. The auxiliary tool according to claim 3 wherein each of the supporting legs is displaceable against the bias of compression springs provided around said supporting legs.

6. The auxiliary tool according to claim 1 wherein the outer tube is provided with an axially extending guiding slot, and the rod is formed of plastic material having at its upper end a lip provided with a transverse screw threaded aperture and a screw extending through said vertical guiding slot in engagement with said aperture, said outer tube having a length scale provided along the guiding slot.

7. The auxiliary tool according to claim 1 including a horizontal guide for said cutting means located between the lower end of said outer tube and said floor, said guide being secured to the outer tube just below the lower end of the tube and having a through-going aperture for the rod.

* * * * *

UNITED STATES PATENT AND TRADEMARK OFFICE

CERTIFICATE OF CORRECTION

PATENT NO. : 4,891,888

DATED : January 9, 1990

INVENTOR(S) : Cornelius H. Maria De Bree et al

It is certified that error appears in the above-identified patent and that said Letters Patent is hereby corrected as shown below:

Column 7, line 8 "ower" should be --lower--

Signed and Sealed this

Twelfth Day of February, 1991

*Attest:*

HARRY F. MANBECK, JR.

*Attesting Officer*

*Commissioner of Patents and Trademarks*